United States Patent [19]

Derkatz

[11] Patent Number: 5,016,793

[45] Date of Patent: May 21, 1991

[54] GUN HOLSTER

[76] Inventor: Keith Derkatz, P.O. Box 1118, Stn. 'A', Kelowna, B.C., Canada, V1Y 7P8

[21] Appl. No.: 419,842

[22] Filed: Oct. 11, 1989

[51] Int. Cl.[5] ..... A45F 3/04

[52] U.S. Cl. ..... 224/209; 224/150; 224/913; 206/317

[58] Field of Search ..... 224/911, 912, 913, 209, 224/149, 150, 204, 205, 215, 216, 257, 259, 916, 191, 196, 200, 208, 234, 251; 206/315.11, 315.1, 317; 2/94

[56] References Cited

U.S. PATENT DOCUMENTS

| | | | |
|---|---|---|---|
| 995,458 | 6/1911 | Harriman | 224/913 |
| 1,884,328 | 10/1932 | Sperling | 224/215 |
| 2,715,989 | 8/1955 | Sjodin et al. | 224/913 |
| 2,781,808 | 2/1957 | Barnard | 224/208 |
| 4,346,827 | 8/1982 | Bianchi et al. | 224/209 |
| 4,693,402 | 9/1987 | Comeau | 224/907 |
| 4,754,904 | 7/1988 | Fischer et al. | 224/259 |

FOREIGN PATENT DOCUMENTS

| | | | |
|---|---|---|---|
| 470276 | 9/1914 | France | 224/913 |
| 318988 | 2/1930 | United Kingdom | 224/913 |

OTHER PUBLICATIONS

Uncle Mike's Sidekick Security, Guns & Ammo; Aug. 1988, p. 34.

A. F. Stoeger, Leather and Canvas Gun Cases, 1931.

*Primary Examiner*—Henry J. Recla

*Assistant Examiner*—Glenn T. Barrett

*Attorney, Agent, or Firm*—Eckert Seamans Cherin & Mellott

[57] ABSTRACT

The invention provides a holster for a longbarrelled gun which allows the gun to be worn by the outdoorsman without impeding his activities such that the gun is always quickly and easily accessible to the wearer. The holster comprises a holster for carrying a gun having a long barrel on the body of the wearer without impeding the activity of the wearer which comprises in combination an elongated sheath adapted to accommodate the barrel of the gun and a harness adapted to fit over the body of the wearer such that the sheath extends down the back of the body of the wearer such that said gun in said holster is readily accessible to the wearer on reaching back over his shoulder whereby to quickly and easily withdraw the gun from the holster.

9 Claims, 1 Drawing Sheet

GUN HOLSTER

BACKGROUND OF THE INVENTION

The present invention relates to gunholsters. In particular, the present invention relates to holsters for long barrelled guns which may be worn on the body without impeding the activities of the wearer and where the gun is always quickly and easily accessible to the wearer.

Outdoorsmen who have activities in the wilderness, such as the forests and bush of British Columbia, Canada such as fishermen, hikers, surveyors and oil field exploration people when indulging in their recreational or professional activity find it necessary to carry a gun so as to defend themselves if attacked by wild animals, in particular by bears, such as brown bears. However, handguns are not effective against large wild animals and the fisherman, for example, usually has to have a more powerful gun which is effective in killing large wild animals, such as bears. Such a gun is longbarrelled gun and by the term longbarrelled gun as used herein and in the claims of this application is meant a gun which has a longer barrel than a hand gun, such as a rifle or a shotgun which may, for convenience, have a shortened barrel or a pistol grip or a collapsible stock. Thus, for example, such guns include riot shotguns and assault rifles. Some typical examples include the Winchester Defender Shotgun, the Remington 870 Riot Shotgun and the Ruger Min 14 Rifle which has a collapsible stock.

Such longer barrelled gun, if carried by the fisherman, impedes his fishing activity and thus heretofore the fisherman has laid the gun on the ground nearby where he is fishing, such as with his fishing tackle. However attacks by bears come very quickly and unexpectedly, the bears travelling at about 45 miles an hour and it is necessary for the fisherman to quickly retrieve his gun ready for firing if the attack turns out to be serious. It is quite probable that in such circumstances the gun is at a distance from the fisherman and not readily accessible to him and under stress of the charging bear the fisherman simply finds it impossible to retrieve his gun.

The present invention provides a holster for a longbarrelled gun of sufficient power to kill large wild animals such as bears which allows the wearer to carry the gun on his body without impeding his activity in the absence of danger from such animals and at the same time allows him to readily and quickly pull the gun from the holster so as to be in a position to fire the gun and thus defend himself against the charging wild animal.

SUMMARY OF THE INVENTION

According to the present invention there is provided a holster for carrying a gun having a long barrel on the body of a wearer without impeding the activity of the wearer which holster comprises in combination an elongated sheath adapted to accommodate the barrel of said gun and a harness adapted to fit over the body of said wearer such that the sheath extends down the back of the wearer such that said gun in said holster is readily accessible to the wearer on reaching back over either shoulder whereby to quickly and easily withdraw the gun from the holster.

Thus, the sheath extends downwardly vertically downwardly roughly from between the shoulder blade of the wearer and accommodates at least a major portion of the barrel of the gun with the pistol grip of the gun or the stock of gun desirably being folded over in view of its length extending upwardly therefrom. It will be readily appreciated that even with the stock folded over on withdrawal of the gun from the holster the gun can be fired without the stock being necessarily folded back into its normal position. The harness is thus adapted to fit over the upper part of the body such that the open upper end of the sheath is roughly between the shoulder blades of the wearer.

In a particularly desirable embodiment of the present invention the harness comprises a pair of straps extending over opposite shoulders from the top of the sheath and a pair of straps extending around opposite sides of the chest of the body of the wearer, which straps are attached at the front of the body of the wearer to a loop strap on either side of the body which can in turn extend to and be looped around a belt around the waist of body of the wearer. The sheath suitably also has a loop strap at the bottom thereof which extends around the belt around the waist of the wearer.

The sheath may be dimensioned to accommodate any type of longbarrelled gun whether the barrel is longer or shorter, whether there is a pistol grip or a collapsible stock or even where the stock is not collapsible. Thus, the gun may be any of those as aforesaid.

The sheath and harness may be made of any suitable material such as ballistic nylon or leather.

BRIEF DESCRIPTION OF THE DRAWINGS

The present invention will be further illustrated by way of the accompanying drawings, in which:

FIG. 3 is a schematic rear view of a person wearing the gun holster of FIGS. 1 and 2; and FIG. 4 is front view of the person of FIG. 3.

DESCRIPTION OF THE PREFERRED EMBODIMENTS

Figure 1:
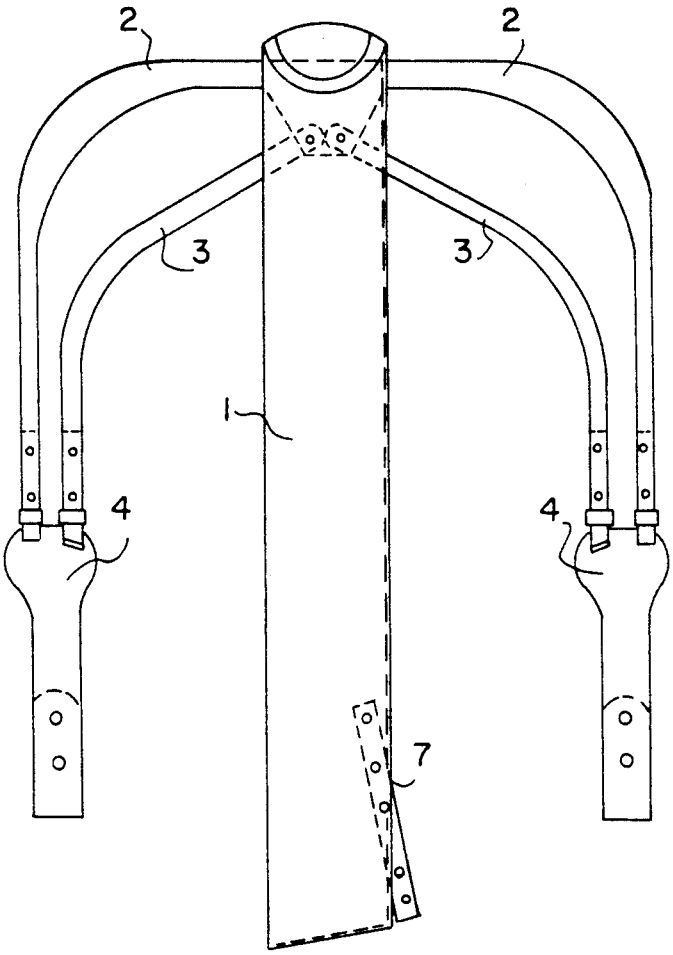
FIG. 1 is a front view of a holster in accordance with one embodiment of the present invention.
Figure 2:
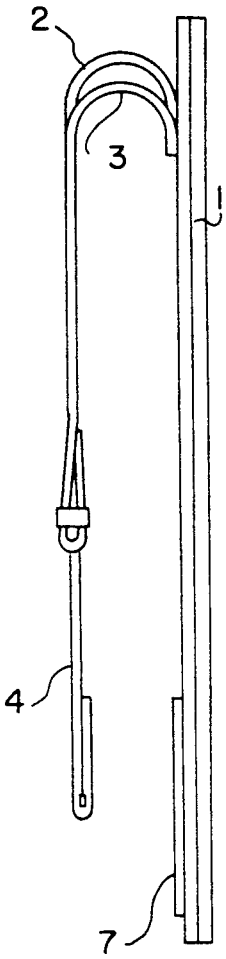
FIG. 2 is side view of the holster of FIG. 1.

Referring to the accompanying drawings, the gun holster which is suitably made from leather or ballistic nylon comprises a sheath 1 for accommodating the long barrel of the gun which is sufficiently powerful to kill large wild animals, such as bears, such that the folded stock or the unfolded stock or the pistol grip of the gun extends upwardly therefrom, generally to the level of the shoulders of the body 6 of the wearer. Attached to the upper end of the sheath is a pair of adjustable shoulder straps 2 and a pair of adjustable chest straps 3. These straps at their other end are attached to an adjustable looped strap 4 for attachment to the belt 5 (FIGS. 3 and 4) on the body 6 of the wearer. The sheath 1 also has adjacent the bottom thereof an adjustable loop strap 7 for attachment to the belt 5 of the wearer. The sheath 1 is dimensioned to accommodate the gun to be carried therein and will have different dimensions depending upon the gun. As seen from FIGS. 3 and 4 the sheath 1 extends vertically down the center of the back of the wearer with the upper end around the shoulder blades such that the piston grip or the collapsed or noncollapsed stock of the gun is readily grippable by the wearer over his shoulder ready for immediate firing.

The holster can also be used for riot shotguns or folded stock rifles. It may also be made of molded leather or ballistic nylon, or Kevlar TM.

I claim:

1. In combination, a gun having a long barrel and a holster for carrying said gun, said holster including an elongated sheath fitted to the barrel of said gun and a harness adapted to fit over the body of a wearer such that the sheath extends down the back of the body of the wearer, whereby said gun in said holster does not impede the activity of the wearer and is readily accessible to the wearer on reaching back over his shoulder, whereby the wearer can quickly and easily withdraw the gun from the holster.

2. The combination as claimed in claim 1, in which the harness is adapted to fit over the upper torso of the body such that the sheath extends substantially vertically downwardly from between the shoulder blades of the wearer.

3. The combination as claimed in claim 2, in which the harness comprises a pair of straps extending over opposite shoulders form an upper end of the sheath and a pair of straps extending around opposite sides of the chest of the wearer beneath the arm, which straps are attached at the front of the body of the wearer to a loop strap on either side of the body which in turn extends to and is looped around a belt around the waist of the wearer.

4. The combination as claimed in claim 3, in which the sheath has a loop strap at a lower end thereof which extends around said belt around the waist of the wearer.

5. The combination as claimed in claim 1, in which the gun has a shortened barrel.

6. The combination as claimed in claim 1, in which the gun is a longbarrelled gun having a pistol grip of a foldable stock.

7. The combination as claimed in claim 1, made of ballistic nylon or leather.

8. A holster for carrying a gun having along barrel on the body of the wearer without impeding the activity of the wearer which comprises in combination an elongated sheath adapted to accommodate the barrel of the gun and a harness adapted to fit over the upper torso of the body such that the sheath extends downwardly from between the shoulder blades of the wearer, such that said gun in said holster is readily accessible to the wearer on reaching back over his shoulder whereby to quickly and easily withdraw the gun from the holster, said harness comprising a pair of straps extending over opposite shoulders from an upper end of the sheath and a pair of straps extending around opposite sides of the chest of the wearer beneath the arm, which straps are attached at the front of the body of the wearer to a loop strap on either side of the body which in turn extends to and is looped around a belt around the waist of the wearer, said sheath having a loop strap at a lower end thereof which extends around said belt around the waist of the wearer.

9. A holster for carrying a gun having a long barrel on the body of the wearer without impeding the activity of the wearer which comprises in combination an elongated sheath adapted to accommodate the a barrel of the gun and a harness adapted to fit over the body of the wearer such that the sheath extends down the body of the wearer, such that said gun in said holster is readily accessibly to the wearer on reaching back over his shoulder whereby to quickly and easily withdraw the gun from the holster, wherein said sheath has a loop strap at a lower end thereof which extends around a belt around the waist of the wearer.

* * * * *